United States Patent [19]

Sengewald

[11] Patent Number: 4,819,412

[45] Date of Patent: Apr. 11, 1989

[54] PROCESS AND APPARATUS FOR THE MANUFACTURE OF A PACKAGE MADE OF A THERMOPLASTIC SYNTHETIC SHEET

[76] Inventor: Karl H. Sengewald, Kreisstr. 16, D-4801 Halle in Westf. 1, Fed. Rep. of Germany

[21] Appl. No.: 144,264

[22] Filed: Jan. 14, 1988

[30] Foreign Application Priority Data

Jan. 22, 1987 [DE] Fed. Rep. of Germany ..... 3701770

[51] Int. Cl.[4] ..... B65B 7/28

[52] U.S. Cl. ..... 53/471; 53/485; 53/282

[58] Field of Search ..... 53/51, 485, 471, 282

[56] References Cited

U.S. PATENT DOCUMENTS

| | | | |
|---|---|---|---|
| 3,193,978 | 7/1965 | Bader | 53/485 X |
| 3,475,878 | 11/1969 | West | 53/51 X |
| 3,792,567 | 2/1974 | Balcome | 53/282 X |
| 3,861,983 | 1/1975 | Harrell | 53/51 X |

FOREIGN PATENT DOCUMENTS

| | | | |
|---|---|---|---|
| 2341911 | 3/1974 | Fed. Rep. of Germany | 53/282 |
| 0121023 | 9/1980 | Japan | 53/282 |

*Primary Examiner*—John Sipos
*Attorney, Agent, or Firm*—Neil F. Markva

[57] ABSTRACT

A process for the manufacture of packages made of prefabricated containers which are substantially dimensionally stable and have at a filling end an outwardly projecting flange edge on which a cover sheet is fixed by welding, hot sealing or bonding. The process comprises the steps of providing a service belt consisting of a thermoplastic sheet material produced in a continuous sheet forming process. The continuous service belt moves along a path through a package forming, filling and closing work station. Recesses are formed in the service belt for receiving the prefabricated containers which are incorporated in succession and in a close spaced relationship into the recesses of the service belt. The prefabricated containers are filled with material and a continuous sheet web including weakening lines defining the outer edge surface dimension of a cover is supplied for each of the containers disposed in the recesses. The sheet web is applied to the containers to register a cover with each of the containers with the covers being separated along the weakening lines to form closed, filled containers. The remaining thermoplastic sheet material in the service belt is removed as waste after the covers have been separated therefrom thereby using the service belt only once as a disposable service belt to form the packages of the process.

14 Claims, 3 Drawing Sheets

10
11
11a
11b
12
13
13a
13b
14
15
16
17
18
18a
19
20
20a
20b
20c
20d
21
21a
21b
22
23
24
25
25a
26
27
28
28a
29
29a
30
30a
31
32
33
34
35
36
45
47
48

PROCESS AND APPARATUS FOR THE MANUFACTURE OF A PACKAGE MADE OF A THERMOPLASTIC SYNTHETIC SHEET

FIELD OF THE INVENTION

The invention relates to a process for the manufacture of packages made of a thermoplastic synthetic sheet in the form of cups or similar containers being substantially dimensionally stable and having at the filling end an edge outwardly projecting as a flange to which a cover sheet is fixed by welding, hot sealing or bonding.

BACKGROUND OF THE INVENTION

Conventional packages of the foregoing kind have been made hitherto by forming, according to the vacuum process, cups from a thermoplastic, synthetic sheet web material, heated sufficiently to be shaped by deep-drawing, placing into said cups the filling material and subsequently covering them by a supplied cover sheet. Thereafter, the packages together with the cover sheet are cut in different ways, for instance by knives guided in longitudinal and transverse direction thereto. While such means are priced reasonably, the resultant packages have sharp corners which do not only affect the outer aspect, but also may cause injuries in use. After all, due to said sharp edges, packages not being stacked above one another may damage adjacent packages during transport. In case of many packages consisting of composite sheets, i.e. of a number of sheet layers, the package content may lose its value by a damage of the external layer, because very frequently, articles are wrapped which, unless food is at stake, are kept in the package for many years.

According to a second known method, the cover face is trimmed by a punch knife to obtain the desired three-dimensional shapes and correspondingly round corners. However, such punch knives are very expensive and, from time to time, they have to be refinished or replaced to ensure a clean cut. Punch knives are also adapted to trim circular covers. Thus, use may be made also of containers made of injection-molded plastics. The stated devices are applicable but only in case of larger quantities of uniform packages. If size or spatial shape of the packages vary, resetting operations, in particular concerning the punch knives, are required with the proviso that the total punching unit has to be disassembled to be replaced by another. For the mentioned reasons and, above all, due to the costs involved therewith, many small factories or other enterprises processing small quantities per unit of time or having a large assortment of different kinds of packages may only realize a reasonably priced packaging by a high outlay. As a result thereof, such factores have recourse, for economic deliberations, to the above mentioned unfavorable solution of cutting with a longitudinal and a transverse knife.

It is an object of the invention to facilitate as much as possible packaging by cups of thermoplastic sheet material closed by a cover sheet thus enabling small factories to perform such operation at a reasonable price in case of low quantities and of varying spatial shapes of the packages.

SUMMARY OF THE INVENTION

To solve this problem, the invention is directed to a process for manufacturing packages of prefabricated containers substantially stable dimensionally and having at the filling end an outwardly projecting flange edge to which a cover sheet is fixed by welding, hot sealing or bonding. The prefabricated cups are continuously incorporated in succession and in a close spaced relationship into respectively assigned, sequentially provided recesses of a service belt consisting of a continuous thermoplastic material produced in a continuous sheet forming process. As the service belt moves through a package forming filling and closing work station, the prefabricated containers are filled with material and a prepared, preferably imprinted sheet web is continuously supplied to said belt, the sheet web being broader than the cup to be closed including its edge. The sheet web includes a limitation enclosing weakening lines, in particular in the form of perforations cuts, which correspond to the surface dimension of a cover for each prefabricated container. The sheet web being connected to the cup edge and the cover face registered with each prefabricated container and being separated from the total sheet web in accordance with the weakening line. The remaining thermoplastic sheet material in the service belt is removed as waste thereby using the service belt only once as a disposable service belt.

Due to the solution of the invention, factories which manufacture and package products are capable of purchasing prepared packaging material, such as cups or similar containers as well as the cover sheet so that, by simple means, only their connection need be generally carried out by welding or bonding and only equipments of a very simple design are to be set up in the factories.

The invention complies with continuously higher requirements to be satisfied concerning packages. Such requirements may be usually fulfilled only by using thermoplastic material having a high melting point such as polypropylene. It is then advisable, for saving costs, to utilize also for deep-drawing the melting heat already present in the plastic sheet from the extrusion or blowing process. However, for economic reasons, this is only possible in larger factories provided with corresponding extrusion or deep-drawing facilities.

According to the instant invention, smaller factories now may buy not only the cups but also the prepared cover sheets which are in such a state that a low technical expenditure is required only for packaging purposes.

Due to the solution of the instant invention, the packages may be produced continuously not only in one row, but also in a number of rows.

The configurations of the belt on which the cups are conveyed may vary. For instance, according to a further embodiment of the invention, the thermoplastic synthetic sheet web is prepared shortly prior to its use by extruding or blowing plastic sheet waste material, and, upon its use, it may become waste, thus creating a service belt. By this means, waste resulting from the production of packages mostly consisting of a composite sheet and not utilizable for new individual sheets may be used to create such a conveyer belt as a service belt.

Said service belt may be designed in different ways. According to a further embodiment of the invention, upon the belt manufacture, cups may be shaped in it by deep-drawing wherein the prefabricated cups are provided to get into contact with the sheet web in which the cover sheets are preformed by weakening lines. This suggestion is particularly favorable for factories which already own a deep-drawing device.

However, if such a deep-drawing equipment does not exist in factories which are not willing either to make use thereof, the invention further provides that upon the manufacture of the service belt, recesses are punched out to receive the assigned prefabricated cups whose borders are supported by the recesses.

If a factory or division of a larger enterprise is using always the same containers for the same articles over a longer period, the disposable service belt may be replaced by a continuously rotating belt provided with recesses. It may be advantageous, within the scope of this measure, to use a plurality of such belts having different recesses and to thus permit to simply interchange, in case of need, one belt against the other.

According to another embodiment of the invention, the strip zones in the service belt free from prefabricated cups and the free strip zones outside the weakening lines in the cover sheet web are provided with imprinted marks and/or are interconnected by local welding to form, prior to the fixation of the cover, a constructional unit, while the mentioned strip zone regions, in particular within the range of the external longitudinal edges of the two webs, are used as attack faces for drives, for instance for belts or chains.

Due to the configuration of the prepared cover sheets, these may be also used in connection with other devices carrying the prepared cups, or with supporting cup conveyer means with the proviso that the cup filled with material is covered with a prepared cover sheet having a surface larger than that of the cup to be closed including its edge, and that perforation cuts or weakening lines are provided in the cover surface by which, upon the joining of the cover sheet to the cup flange, the overlying, outwardly projecting edge of the cover sheet is separated. Also according to this solution, it is suggested to cover simultaneously a number of filled cups by a coherent cover sheet in which weakening lines, in particular perforation cuts, are assigned to each cup, while the strips in the cover sheet in the range between the cover faces limited by the weakening lines are used to provide tear flaps.

It is further provided that the stripes in the cover sheet in the range between the cover faces limited by the weakening lines are used as conveying means for the cover sheets.

It is favorable, also in case of this embodiment that the strips of the cover sheet in the range between the cover faces limited by the weakening lines are provided with imprinted marks for controlling and aligning the cover sheet relative to the cups filled with material.

Therefore, concerning the cover sheet production, it is suggested to apply for their formation in a sheet web made of paper or of thermoplastic synthetic material or of a combination of both materials, continuously juxtaposed and successively arranged weakening lines enclosed by a limitation, in particular perforation cuts, and to leave free zones in longitudinal direction of the sheet web, in particular in the region of the longitudinal edges serving for the transport of the sheet web.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figures 1, 2, 3:
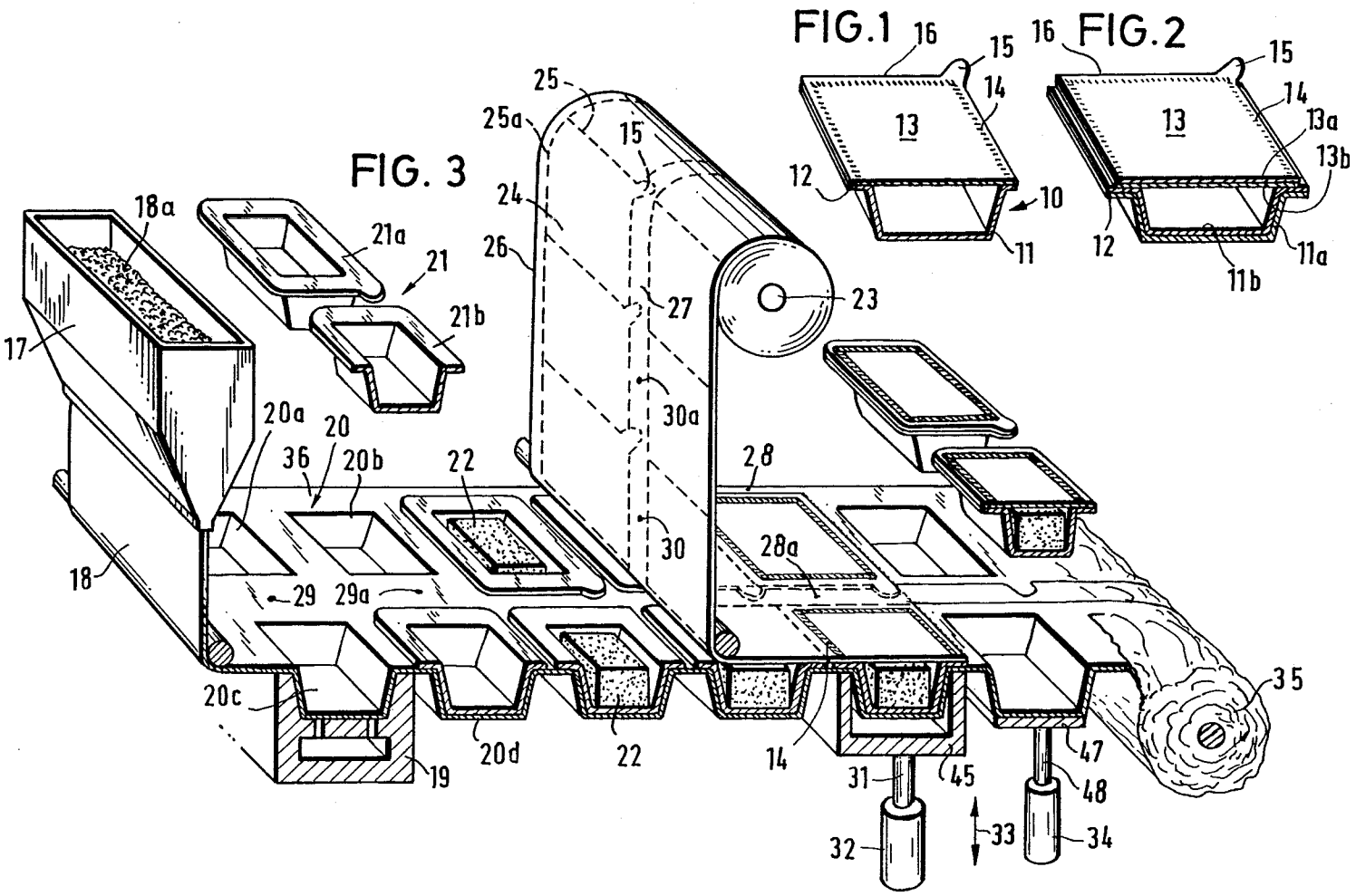
FIG. 1 shows a cross section of the package.
FIG. 2 is a cross section of another package.
FIG. 3 is a perspective and substantially schematic view of the apparatus and the process for the manufacture of the package.

As evident from FIG. 1, package 10 consists of a container or cup 11 made of a single-layered thermoplastic sheet material and realized from a sheet deep-drawn by vacuum. However, said cup may also consist of a thin-walled injection-molded plastic material. The cup provided with a flange-type circumjacent border 12 is closed at its top by a cover sheet 13 which may be of synthetic material. However, it may be also made of paper or of a paper-like cellulose material. The cover sheet is joined to flange 12 by connection 14 which may be achieved by welding with the use of pressure and temperature, but also by hot sealing with the use of a lower pressure or by bonding. The cover sheet 13 is provided with a tear flap 15.

FIG. 2 shows a package wherein the deep-drawn cup consists of sheet layers 11a and 11b and the cover of sheet layers 13*a* and 13*b*. It is possible, in this case, that the external sheet layer 13*a* is made of paper, while the internal sheet layer 13*b* is made of a plastic sheet provided with a plurality of perforations due to which the filling material may be sterilized within the package.

As obvious from FIG. 2, border 12 of the packages slightly projects to the outside, because the external edge 16 of the single- or double-layered cover sheet is torn away in the perforation or weakening line, since, as explained hereunder, the cover sheet is formed from a prepared sheet web.

FIG. 3 shows extrusion means 17 defining a service belt forming work station and comprising the synthetic granular material 18*a* originating from sheet waste products which, in a plastic-processing factory, in particular during the production of packages, is continuously left over. What is extruded or blown, is the plastic web 18 which moves from the belt forming work station through a package forming, filling and closing work station as shown.

Known deep-drawing means 19 forms closely spaced troughs 20*a* and 20*b* successively and also side by side in one row and 20*c*, 20*d*, in the other row. In said troughs, the prefabricated cups 21*a* are subsequently inserted in one row, and 21*b* in the other row. As a rule, said cups 21 are purchased from firms specialized in the manufacture of such containers. These may be deep-drawn from single-layered sheets, but they may be also obtained by injection molding. They particularly consist of a composite sheet, wherein the melt index of the external sheet is high, while the internal sheet is suitably weldable. Upon the insertion of said cups into the troughs, the filling material 22 is inserted. It should be noted that the filling material may have been already introduced into the cups 21 before they are placed into the troughs 20 of belt 18. Subsequently, from roller 23, a web 24 is delivered for providing the cover sheet 13 which may consist of plastic, but also of cellulose or of a combination of both materials.

As shown in FIG. 3, the web comprises, in an enclosed region, weakening lines 25, 25*a* in the form of perforations, i.e. cuts with small tear-open lands intermediate them. The tear flap 15 is also surrounded by a weakening line. The zones within the weakening lines shaped as a closed "ring" form the cover sheet 13. As evident from FIG. 1, the weakening lines are in adjacent relationship. Cover sheets adjoined in transverse direction may comprise one sole weakening line, while, in longitudinal direction, strips are left, such as for instance the visible strip 26 at the left border 26 and strip 27 in the center. The central strip zone comprises tear flaps 15.

Preferably, said strip zones are provided with imprinted marks, but also with point-shaped welding connections 28 and 28*a* to permit to obtain a unit between sheet 18 and cover sheet web 24. Further, imprinted marks 29, 29*a* in web 18, and imprinted marks 30, 30*a* assigned to sheet web 24 may assist in achieving an exact alignment between sheet webs 18 and 24, thus ensuring that the cover sheets obtained by separation from sheet web 24 are in exact agreement borderwise with the external border of cups 11. "Exact agreement borderwise" is also meant to express that, in accordance with the illustration and description of FIG. 2, the border of the cover sheet may be reset slightly inwardly from the border of the cup in order to conceal as much as possible the lands between the perforation cuts.

The dimensions of said lands are already very small. Since the weakening line is reset inwardly relative to the external edge of the package flange, an outward projection of the lands, although they are so small, is safely excluded.

Upon the aligned placing of the cover sheet web on sheet web 18 carrying the cups, welding is performed by applying a welded seam 14 with the use of a known, non-illustrated welding tool. However, the drawing shows the counterwelding seat 45 in the form of a U-shaped channel which, via piston rod 31 may be lifted and lowered in cylinder 32 in the directions indicated by the double arrow 33, to ensure that, upon the welding operation, belt 18 may travel further. Upon the termination of welding, sealing or of another connection, the covers are lifted together with the container. This may be achieved by a pressure exerted from below via a punch 47 with piston 48 and cylinder 34 whereby the weakening line is torn open. Strips 26 and 27 of the cover sheet web are left with the carrier web 18 to be subsequently wound altogether to a roll 35 carried away as waste, or to be comminuted to granular material for a repeated use such as disclosed above, in that, via the extrusion means 17, a new sheet web 18 is made available which forms the carrier web referred to hereinafter as service belt.

Figure 4:
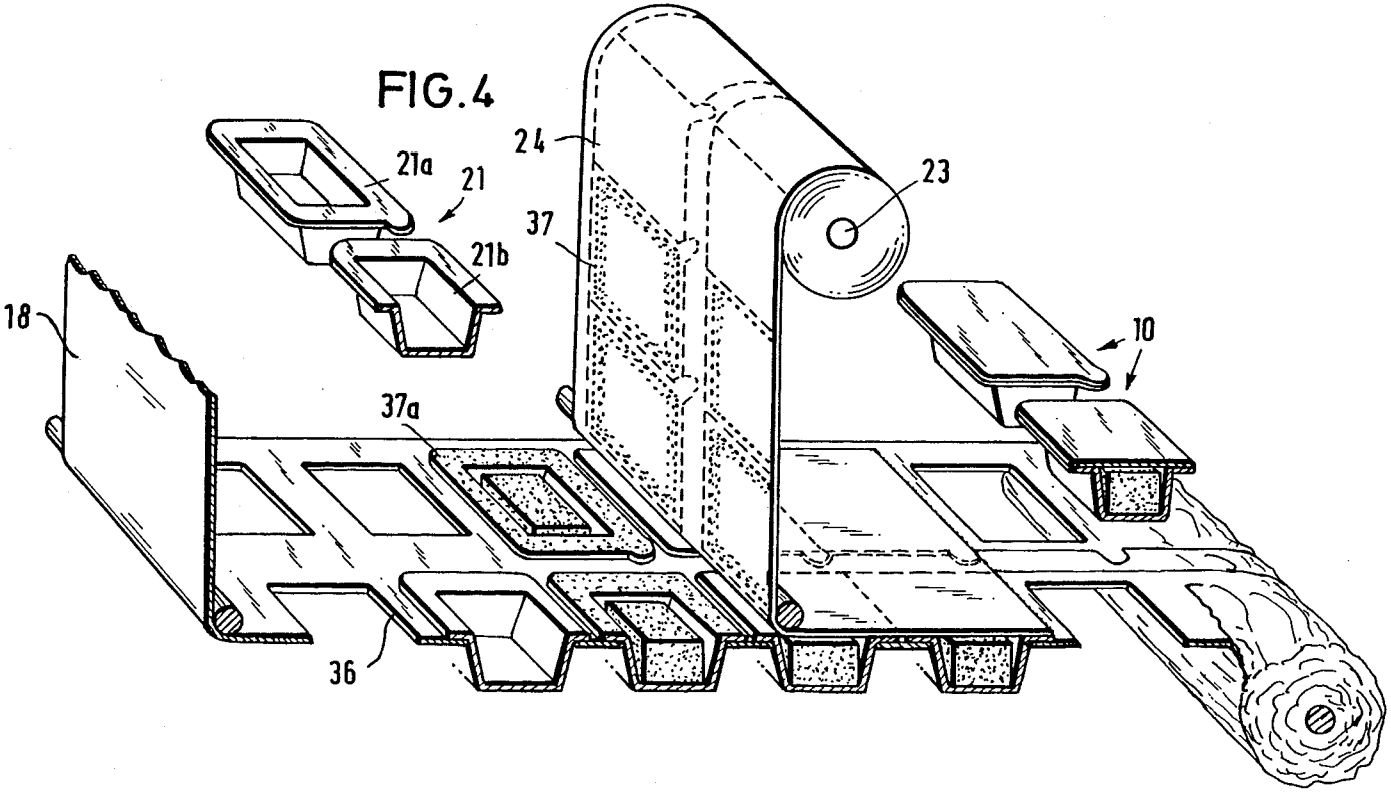
FIG. 4 is a modification of FIG. 3.

FIG. 4 shows a service belt 18 which may be purchased together with the prepared cover sheet web 24 so that in the factory filling and closing the package, no extra extrusion means need be available. Instead of troughs 20 shown in FIG. 3, shapes corresponding to cups may be punched out by a known punching means in such a way that the flanges of the cups may rest on sheet web 18. It is not absolutely necessary for the blanks to be punched out by a clean cut. It must be only ensured that the prepared cups purchased are in alignment with the weakening lines in the cover sheet web 24. Again, marks or similar control means may be provided, such as disclosed in FIG. 3, by taking into consideration, that the strip-shaped zones 36 at the external longitudinal border of web 18 as well as the corresponding zones of the cover sheet web are utilized for transport purposes.

In another modified embodiment of FIG. 3, the welding means for establishing a connection of the cover sheet to the flange of the cup is omitted in FIG. 4, whereas on the cover sheet web, an adhesive coating 37 is applied as a closed ring which is provided subsequent to the imprinting of the marks and to the provision of the perforation cuts. In other words, also the connecting means for applying the cover sheet to the cup may be already prefabricated. Suitably, the outside of the adhesive layer is covered by a very thin silicon paper which is timely removed prior to the contact of the cover sheet web with the service sheet web. FIG. 4 shows the solution concerning the service sheet web used but once to be subsequently wound up and finally destroyed. The adhesive coating 3*a* may be also applied to the top sides of the flanges of the prefabricated cups. Since they project upwardly beyond the carrier web, in particular used as service web, the use of a roller applying the adhesive is easily practicable.

Figure 5:
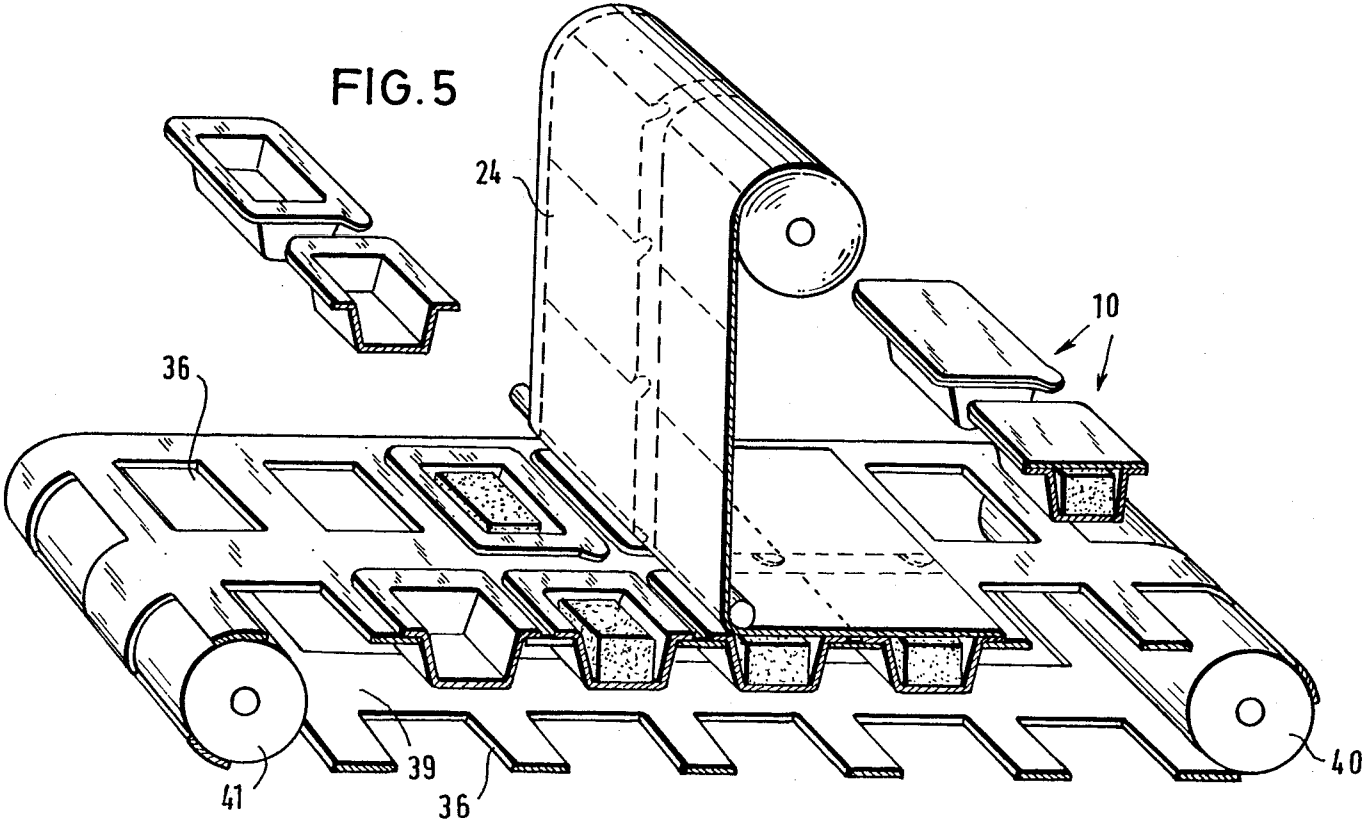
FIG. 5 is another modification of FIG. 3.

FIG. 5 shows a modified embodiment in which web 18 provided with cutouts is continuously rotating around the guide rollers 40 and 41. This is a practical design for productions running over a longer period with the use of the same kind of packages. Said belt 39 may be simply interchanged against another. Preferably, it is also provided with imprinted marks.

As evident from the foregoing specification, a number of modifications and simple measures for packing material are possible due to the solution of the invention which, by a reduced constructional expenditure, allows a great variety of changes.

What is claimed is:

1. A process for the manufacture of packages made of prefabricated containers substantially dimensionally stable and having at a filling end an outwardly projecting flange edge on which a cover sheet is fixed by welding, hot sealing or bonding, said process comprising the steps of:

(a) providing a service belt consisting of a continuous thermoplastic sheet material produced in a continuous sheet forming process, (b) moving the continuous service belt along a path through a package forming, filling and closing work station, (c) forming recesses in the service belt for receiving said containers and incorporating the prefabricated containers in succession and in a close spaced relationship into the recesses of the service belt, (d) filling the prefabricated containers with material, (e) supplying a continuous sheet web including weakening lines defining the outer edge surface dimension of a cover for each of the containers disposed in said recesses, (f) applying the sheet web to the containers to register a cover which each of the containers, (g) separating the covers along the weakening lines to form closed, filled containers, and (h) removing the remaining thermoplastic sheet material in the service belt as waste after the covers have been separated thereby using the service belt only once as a disposable service belt to form the packages of the process.

2. A process as defined in claim 1 wherein the recesses formed in the service belt are juxtaposed in at least two lines laterally spaced along said belt, and the prefabricated containers are juxtaposed and inserted simultaneously into the recesses of the belt.

3. A process as defined in claim 1 wherein the recesses of the service belt are formed by deep-drawing cup-shaped troughs in said belt to receive prefabricated containers similarly shaped as the deep-drawn troughs, both said prefabricated containers and the service belt being contacted with the continuous sheet web including the cover sheets defined by the weakening lines.

4. A process as defined in claim 1 wherein the recesses forming step includes stamping out openings in the service belt, each said opening having a shaped peripheral edge shaped to receive prefabricated containers having borders supported by the outer peripheral edges of the openings.

5. A process as defined in claim 1 wherein the service belts includes strip-shaped zones between the prefabricated containers disposed in the service belt and free strip-shaped zones outside the weakening lines defining the covers, said strip-zones include imprinted indicia for controlling and aligning the cover sheet with respect to the filled containers.

6. A process as defined in claim 1 wherein the service belts includes two external longitudinal edges and strip-shaped zones between the prefabricated containers disposed in the service belt and free strip-shaped zones outside the weakening lines defining the covers, said strip-shaped zones between the external longitudinal edges of the service belt are used as attack faces for moving said service belt along said path.

7. A process as defined in claim 1 wherein the service belt is formed of material selected from the group consisting of paper, thermoplastic synthetic material and combinations thereof.

8. A process as defined in claim 1 wherein the prefabricated containers are covered with a prepared cover sheet having a surface larger than the container surface to be closed including the container edges, said cover surface includes weakening lines for separating the cover sheet from the service belt upon joining the cover sheet to the flange edge of the prefabricated container.

9. A process as defined in claim 8 wherein the sheet web applying step includes simultaneously covering a plurality of prefabricated containers filled with material by a coherent cover sheet defined by weakening lines registered with respect to each container, said cover sheet includes tear flaps provided by strips between the cover faces.

10. A process as defined in claim 9 wherein the strips of the cover sheet in the area between the cover faces defined by the weakening lines are used to move the cover sheets along said path.

11. A process as defined in claim 9 wherein the strips of the cover sheet in the area between the cover faces defined by the weakening lines include imprinted indicia for controlling and aligning the cover sheet with respect to the prefabricated containers filled with material.

12. A process as defined in claim 1 wherein the continuous thermoplastic sheet material is produced from waste synthetic thermoplastic material in the continuous sheet forming process.

13. A process as defined in claim 12 wherein the continuous sheet forming process is performed at a service belt forming work station ahead of the package forming, filling and closing work station, said service belt providing step includes moving the service belt from the belt forming work station to the package forming, filling and closing work station.

14. A process as defined in claim 13 wherein the waste removing step includes recycling said service belt waste material to the continuous sheet forming process at the service belt forming work station.

* * * * *